United States Patent [19]

Kupersmit

[11] 4,358,048

[45] Nov. 9, 1982

[54] COLLAPSIBLE SHIPPING CONTAINER HAVING REINFORCED BASE ELEMENT

[76] Inventor: Julius B. Kupersmit, 145-80-228th St., Springfield Gardens, N.Y. 11413

[21] Appl. No.: 257,127

[22] Filed: Apr. 24, 1981

[51] Int. Cl.[3] ..... B65D 5/36; B65D 13/00

[52] U.S. Cl. ..... 229/23 BT; 229/41 R; 220/441

[58] Field of Search ..... 229/6 R, 23 R, 41 R, 229/23 BT; 220/441, 416, 443

[56] References Cited

U.S. PATENT DOCUMENTS

| | | | |
|---|---|---|---|
| 2,534,010 | 12/1950 | Frye | 229/23 R |
| 2,534,011 | 12/1950 | Frye | 229/23 R |
| 3,291,364 | 12/1966 | Fischer | 229/23 R |
| 3,337,036 | 8/1967 | Peterson | 229/23 R |
| 3,443,737 | 5/1969 | Kupersmit | 229/23 R |
| 3,917,154 | 11/1975 | Done | 220/441 |
| 4,019,634 | 4/1977 | Bonnot | 229/23 R |
| 4,085,837 | 4/1978 | Jacalone | 229/23 BT |
| 4,252,266 | 2/1981 | Kupersmit | 229/41 R |

FOREIGN PATENT DOCUMENTS

| | | | |
|---|---|---|---|
| 5775 | of 1902 | United Kingdom | 229/41 R |

*Primary Examiner*—Herbert F. Ross
*Attorney, Agent, or Firm*—Charles E. Temko

[57] ABSTRACT

A fiberboard large size shipping container of a type which may be conveniently collapsed after use for return to a shipping source for reuse. In lieu of the usual wood or plastic pallet which forms a base for the container, a solid or corrugated fiber sheet is provided, the free edges of which extend outwardly of the body of the container to form part of a bottom wall thereof and a means for forklift engagement. The lower portion of the vertical walls of the container are provided with a reinforcing element to resist outwardly directed forces caused by fluid or particulate loads.

3 Claims, 4 Drawing Figures

COLLAPSIBLE SHIPPING CONTAINER HAVING REINFORCED BASE ELEMENT

BACKGROUND OF THE INVENTION

This invention relates generally to the field of collapsible reusable shipping containers of a type disclosed in my prior U.S. Pat. No. 3,443,737 dated Apr. 13, 1969, and more particularly to an improved form thereof. Reference is also made to U.S. Pat. No. 4,252,266, which discloses a related invention.

Such shipping containers are primarily used for air and truck transport, where considerations of space and weight are normally of greater importance than the cost of fabrication, particularly where the container may be reused as many as one half dozen or more times before it becomes so worn that it must be discarded. However, in recent years, the cost of manufacture has increased substantially, and is currently a factor of more than nominal importance.

While conventional wood pallets or the synthetic resinous equivalent thereof have been considered an essential part of the container, which is otherwise formed of multi-ply corrugated fiberboard, such pallets are relatively heavy, and occupy a height of forty six inches which might otherwise be occupied by actual cargo. In conventional constructions, the side walls of the container are fastened to the upper or side surfaces of the pallet, and rely upon the pallet for structural rigidity. It has not heretofore been appreciated that the same side walls possess unutilized strength both in tension and compression in the plane of said side walls.

In my abovementioned copending application, Ser. No. 157,416, there is disclosed a collapsible shipping container of the class described in which the conventional pallet element of wood or synthetic resinous material has been eliminated with a corresponding saving in the cost of manufacture, occupied space, and weight. In lieu thereof, the lower edges of the side walls are glued or otherwise secured to the upper surface of a planar fiber base member, the outer edges of which extend outwardly of the plane of the outer surfaces of the side walls. The gluing of the lower edge flaps of the side walls to the upper surface thereof provides substantial additional rigidity in the planes of the walls to enable the container to function without a conventional pallet.

While this structure is suitable for many types of loads, in the case of very dense loading, as encountered with fluid or particulate materials, stresses are placed upon the side walls in planes normal to the planes of the walls which tend to cause bulging particularly adjacent the lower edges of the side walls, as well as against the lower portions of the folding doors which are not as securely entered as the remaining side wall, the lower edge flaps of which are glued to the upper surfaces of the horizontal fiber member which replaces the pallet.

SUMMARY OF THE INVENTION

Briefly stated, the invention contemplates the provision in a container of the above described type of a tray-like reinforcing element interposed between the side wall element and the fiber member. The element includes a bottom wall, a lower surface of which is glued to the upper surface of the fiber member. The gluing flaps of the side wall elements are glued to the upper surface of the bottom wall of the reinforcing element. Integral with the reinforcing element bottom wall are a plurality of low side walls, the inner surfaces of which are glued to the corresponding outer surfaces of the normal side walls to provide additional rigidity at the lower portion of the container. The walls of the container are foldable as disclosed in my abovementioned copending application, but folding takes place above the upper border of the reinforcing element, and the folded side wall portions may thereafter project at least partially into an enclosure formed by the reinforcing element. The lid or cover element is provided with side walls, the height of which correspond to the height of the reinforcing element, so that when engaged directly thereupon, when the device is in collapsed condition, more than adequate strength is obtained to resist crushing.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
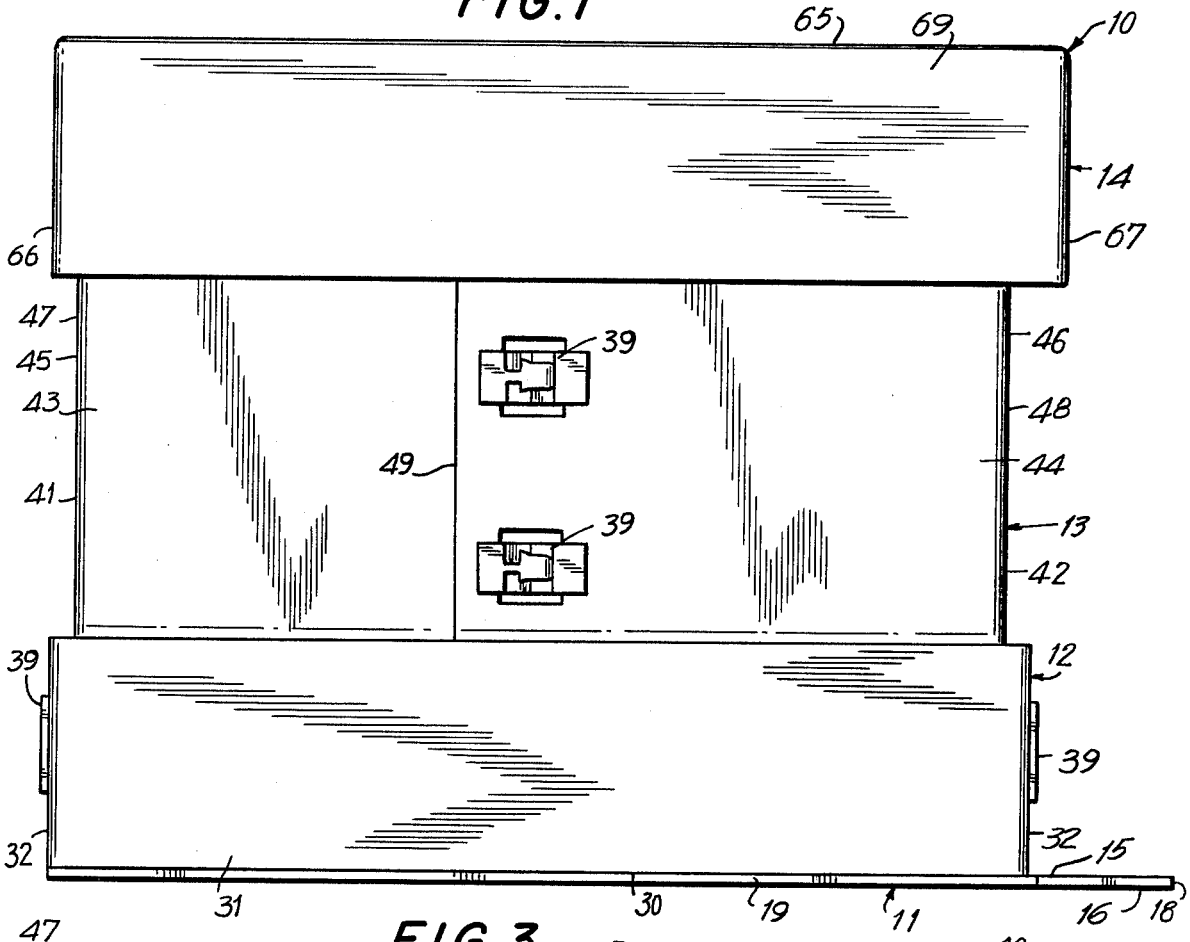
FIG. 1 is a front elevational view of an embodiment of the invention.
Figure 3:
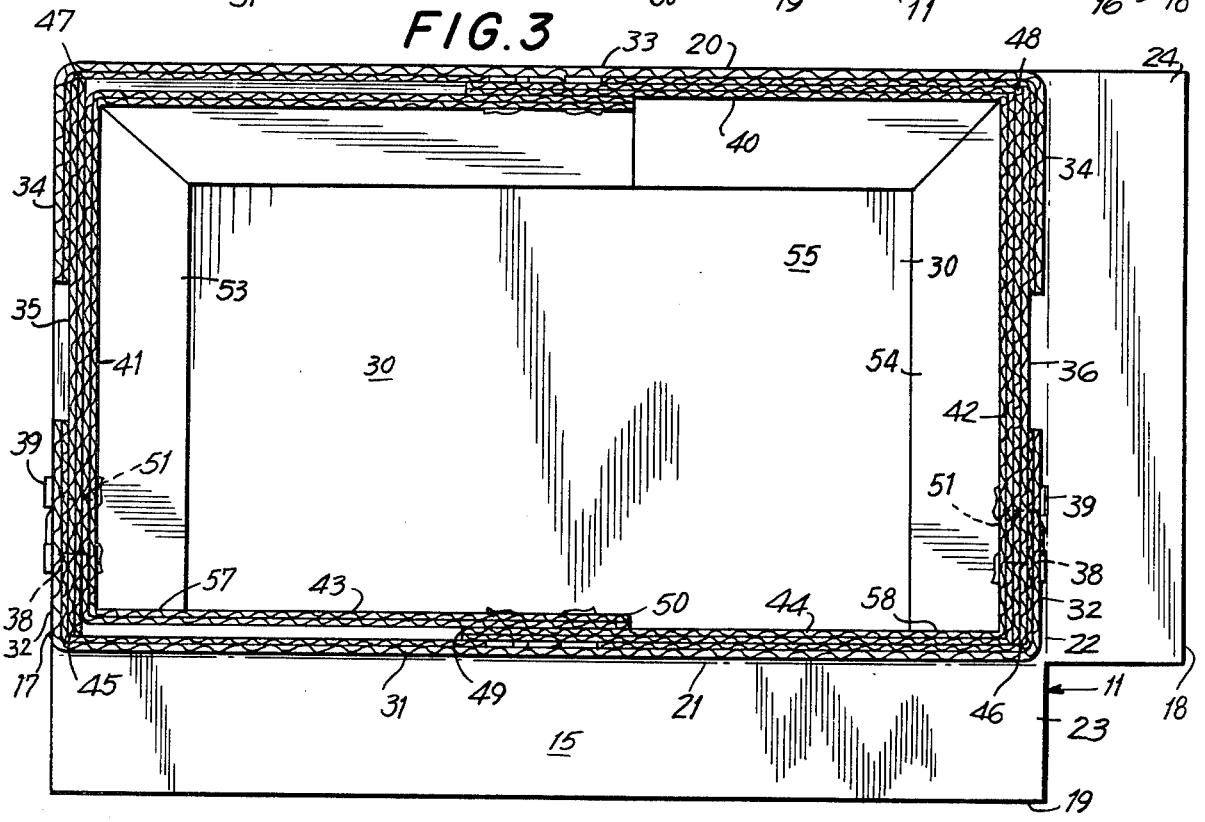
FIG. 3 is a top plan view thereof with a cover element removed.
Figure 2:
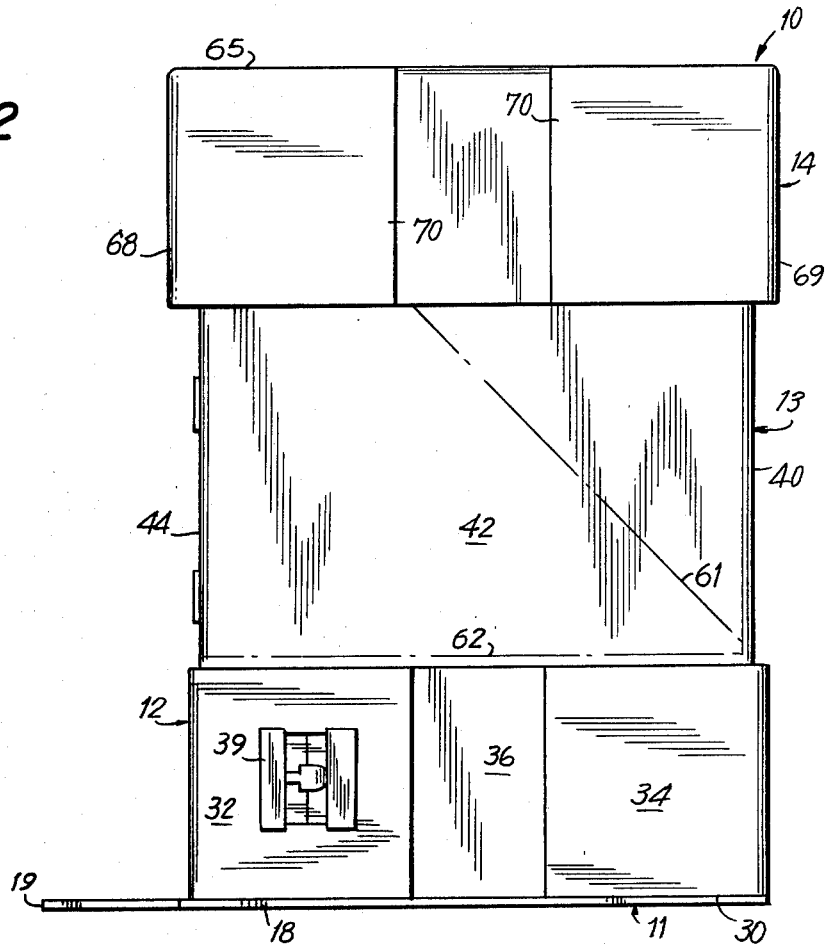
FIG. 2 is a side elevational view thereof.
Figure 4:
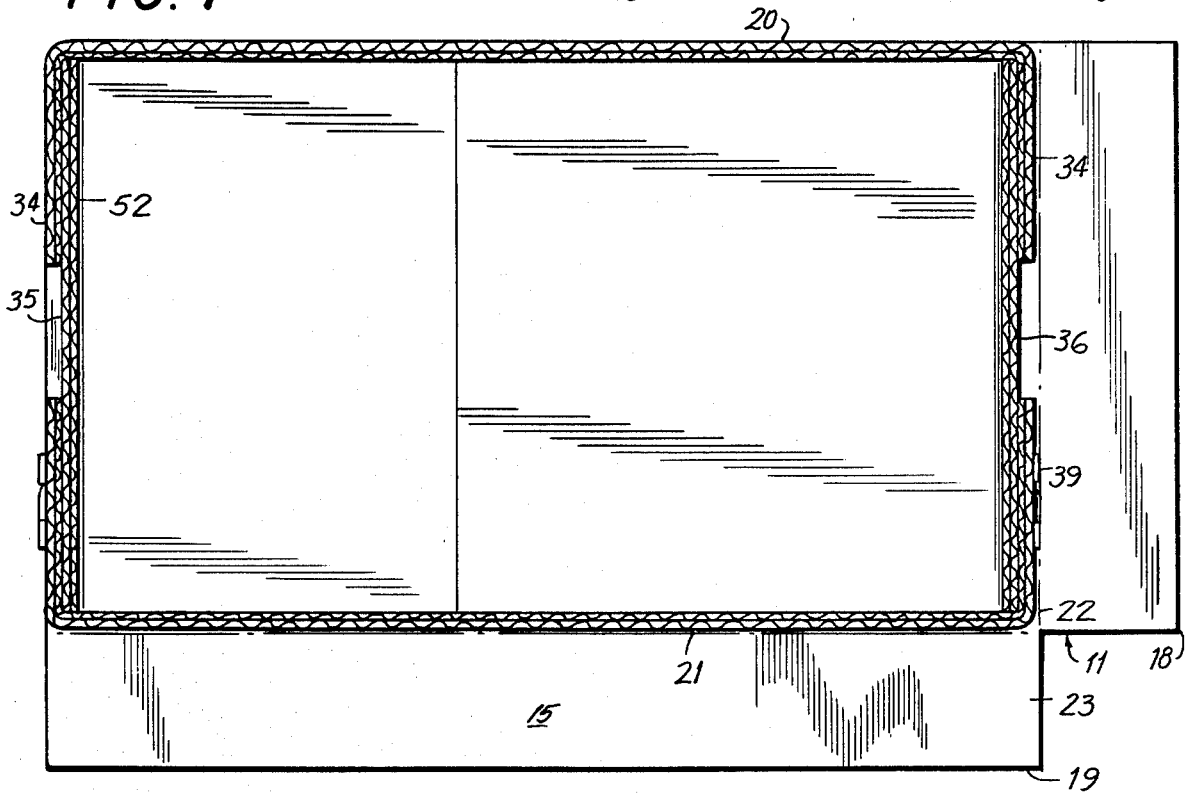
FIG. 4 is a top plan view thereof showing the embodiment in collapsed condition with cover removed.

In accordance with the invention, the device, generally indicated by reference character 10, comprises broadly: a base element 11, a reinforcing element 12, a side wall element 13, and a lid or cover element 14.

The base element 11 is presently formed of fiberboard, although it can also be formed from corrugated material. It is bounded by an upper surface 15, a lower surface 16, side edges 17 and 18, a front edge 19, and a rear edge 20. A front score line 21 and a side score line 22 form lips 23 and 24 extending outwardly of the side wall element 13 and providing a guiding means for forklift engagement.

The reinforcing element 12 includes a bottom wall 30, a foldably interconnected front wall 31 having side flaps 32, an integral rear wall 33 having corresponding side flaps 34, and glued side walls 35 and 36, the above walls forming an open topped enclosure accommodating the side wall element 13. The flaps 32 are provided with alignable openings 38 secured by known connectors 39, for example, the connector disclosed in my prior U.S. Pat. No. 4,239,149, dated Dec. 16, 1980.

The side wall element 13 is preferably of unitary construction, and includes a rear wall 40, a pair of side walls 41 and 42 and selectively overlapping first and second front walls 43 and 44. These are interconnected by fold edges 45, 46, 47 and 48, and are bounded by the vertical free edges 49 and 50. The side walls 41 and 42 are provided with alignable openings 51 corresponding to the openings 38 and are bounded by a continuous upper edge 52. Gluing flaps 53 and 54 are secured to the upper surface 55 of the bottom wall 30. The front walls 43 and 44 do not have gluing flaps, and are bounded by free lower edges 57 and 58 which are positionable into upwardly facing channels 59 formed by the vertical edges of the side walls 35 and 36.

The side walls 41 and 42 are provided with angularly disposed fold lines 61 and horizontal fold lines 62 which are positioned immediately above the upper edge of the reinforcing element 12 to enable them to be folded without distorting the reinforcing element. Upon the occurrence of such folding to collapse the container, parts of the side wall element 13 will be at least partially disposed within the enclosure formed by the reinforcing element 12, so that the lid or cover element 14 may rest directly thereupon to be supported thereby.

The lid or cover element 14 is also of unitary planar construction and is preferably not of collapsible type. It includes a top wall 65, end walls 66 and 67 and side walls 68 and 69 having glued flaps 70, the interconnection of which makes a relatively rigid element. The walls 66–69, inclusive, are preferably of a vertical type corresponding to that of the walls of the reinforcing element 12, so that when the cover element is placed over the collapsed side wall element 16, the cover element and base element reinforce each other to provide a high degree of compressive strength preventing damage to the collapsed container by the placing of loads thereon during return shipment.

As in prior art constructions, it is possible to unload the device 10 by outwardly swinging the front walls of the side wall element 13 after removing the cover element. When this is desired, the flaps positioning the front wall 31 in vertical position are released, and the front wall is then pivoted outwardly to enable the front walls of the side wall element to pass thereover. When the container is subsequently collapsed, the flaps are again resecured to enable the reinforcing element 12 to maintain its rigidity.

It will be observed that when the erected device 10 is filled with a heavy particulate material, the bulk of the horizontal forces developed by the load will be counteracted by the presence of the reinforcing element 12 which overlies the outer surfaces of the side wall element 13. Additional rigidity may be obtained by providing fastener interconnection between the lower portions of the front walls of the side wall element 13 and the front wall of the reinforcing element 12, at a slight cost of inconvenience in that it is necessary to disconnect the fasteners before opening the carton for unloading through the opened front wall of the side wall element 13.

It will be observed that the above described construction places a substantial amount of reinforcing corrugated board in the area where it is most needed, that is to say, immediately above the base element 11 where the bulk of radially outward stresses occur. The additional cost of manufacture, as contrasted with that of fabricating the device disclosed in my abovementioned copending application is relatively small, and this structure may be fabricated from a single blank of material. As a result, the additional weight involved in reinforcing the container is relatively low.

I wish it to be understood that I do not consider the invention limited to the precise details of structure shown and set forth in this specification, for obvious modifications will occur to those skilled in the art to which the invention pertains.

I claim:

1. An improved collapsible shipping container comprising: a base element, a reinforcing element, a side wall element, and a lid element; said base element being of generally planar rectangular configuration, and having upper and lower surfaces; said reinforcing element including a bottom wall having its lower surface secured to said upper surface of said base element, front and rear walls foldably interconnected to said bottom wall, each having foldably interconnected flaps thereon, said front and read walls and associated flaps being interconnected to form an open topped enclosure; said side wall element including a single piece of fiberboard forming a rear wall, first and second side walls, and first and second front walls selectively secured in mutually overlapped relation when said container is erected and closed; said side and rear walls of said side wall element each having foldably interconnected elongated flaps at the lower edges thereof, said elongated flaps being secured to the upper surface of said bottom wall of said reinforcing element; said overlapping front walls having lower portions thereof disposed within said enclosure; said side walls of said side wall element having fold lines disposed thereon and positioned above said enclosure, whereby said side wall element may be folded to generally planar condition at least partially extending into said enclosure; said cover element including a top wall selectively overlying said enclosure, and side walls corresponding in height to those of said reinforcing element.

2. A shipping container in accordance with claim 1, further characterized in said reinforcing element including a pair of oppositely disposed side walls interconnecting the flaps of said front and rear walls.

3. A shipping container in accordance with claim 1, further characterized in said front wall of said reinforcing element being foldably interconnected to said bottom wall at a lower edge thereof, and detachably secured in vertical position to enable clearance for said front wall of said side wall element to be moved outwardly thereover.

* * * * *